US009352347B2

(12) United States Patent
Arminak

(10) Patent No.: US 9,352,347 B2
(45) Date of Patent: May 31, 2016

(54) FOAMER PUMP

(75) Inventor: Armin Arminak, Azusa, CA (US)

(73) Assignee: Arminak & Associates, LLC, Azusa, CA (US)

( * ) Notice: Subject to any disclaimer, the term of this patent is extended or adjusted under 35 U.S.C. 154(b) by 0 days.

(21) Appl. No.: 13/556,791

(22) Filed: Jul. 24, 2012

(65) Prior Publication Data

US 2012/0285994 A1 Nov. 15, 2012

Related U.S. Application Data

(63) Continuation of application No. 12/912,649, filed on Oct. 26, 2010, now Pat. No. 8,225,965, which is a continuation of application No. 11/724,412, filed on Mar. 15, 2007, now Pat. No. 7,850,048.

(60) Provisional application No. 60/854,019, filed on Oct. 23, 2006.

(51) Int. Cl.
*B05B 11/00* (2006.01)
*B05B 7/00* (2006.01)

(52) U.S. Cl.
CPC ..... *B05B 11/3047* (2013.01); *B05B 11/3053* (2013.01); *B05B 11/3069* (2013.01); *B05B 11/3087* (2013.01); *B05B 11/3094* (2013.01); *B05B 7/0037* (2013.01)

(58) Field of Classification Search
CPC ..... B05B 11/3087; B05B 11/3047; B05B 11/3001; B05B 7/0037; A47K 5/14
USPC ..... 222/190, 321.9, 145.5, 135, 321.2, 209
See application file for complete search history.

(56) References Cited

U.S. PATENT DOCUMENTS

| | | | | |
|---|---|---|---|---|
| 5,271,530 | A | | 12/1993 | Uehira et al. |
| 5,364,031 | A | | 11/1994 | Taniguchi et al. |
| 5,443,569 | A | | 8/1995 | Uehira et al. |
| 5,462,208 | A | | 10/1995 | Stahley et al. |
| 5,570,819 | A | | 11/1996 | Uehira et al. |
| 5,918,771 | A | * | 7/1999 | van der Heijden ..... 222/136 |
| D418,746 | S | | 1/2000 | Featherston et al. |
| 6,053,364 | A | * | 4/2000 | van der Heijden ..... 222/145.6 |
| 6,170,713 | B1 | | 1/2001 | Schultz |
| D452,822 | S | | 1/2002 | Boshuizen et al. |

(Continued)

FOREIGN PATENT DOCUMENTS

| | | |
|---|---|---|
| EP | 0 392 238 A | 10/1990 |
| EP | 0 613 728 | 7/1994 |

(Continued)

*Primary Examiner* — Kevin P Shaver
*Assistant Examiner* — Charles P Cheyney
(74) *Attorney, Agent, or Firm* — Woodard Emhardt Moriarty McNett & Henry LLP

(57) ABSTRACT

A foamer pump for dispensing foam has a simple construction and utilizes a single piston to reduce the volume of both a fluid chamber and an air chamber. A portion of the actuating mechanism helps to unseat a check valve at the outlet of the fluid chamber. The foamer pump has a fluid chamber, and an outlet of the fluid chamber is connected to a mixing chamber. An air chamber has an air channel that connects the air chamber to ambient air in a first position and to the mixing chamber in a second position. A piston causes the volume of the air chamber and the liquid chamber each to be reduced, forcing air from the air chamber and foamable fluid from the liquid chamber into the mixing chamber where they blend to form an air/liquid mixture.

9 Claims, 3 Drawing Sheets

(56) References Cited

U.S. PATENT DOCUMENTS

| | | | | |
|---|---|---|---|---|
| 6,446,840 | B2 | 9/2002 | Ophardt et al. | |
| 6,612,468 | B2 | 9/2003 | Pritchett et al. | |
| 6,644,516 | B1 | 11/2003 | Foster et al. | |
| 6,840,408 | B1 * | 1/2005 | Foster | B05B 11/3074 222/190 |
| 6,923,346 | B2 | 8/2005 | Foster et al. | |
| 7,004,356 | B1 | 2/2006 | Sayers | |
| 7,048,153 | B2 * | 5/2006 | Gentile | 222/190 |
| 7,717,301 | B2 * | 5/2010 | Tsai | 222/190 |
| 8,376,190 | B2 * | 2/2013 | Choi | B05B 7/0037 222/135 |
| 8,561,849 | B1 * | 10/2013 | Wang | B05B 11/0075 222/145.5 |
| 8,678,241 | B2 * | 3/2014 | Wang | B05B 7/0037 222/190 |
| 2002/0056730 | A1 * | 5/2002 | van de Heijden | 222/190 |
| 2005/0115988 | A1 * | 6/2005 | Law et al. | 222/145.5 |
| 2006/0157512 | A1 | 7/2006 | Van der Heijden | |
| 2007/0119864 | A1 | 5/2007 | Tsai | |
| 2009/0008412 | A1 * | 1/2009 | Choi et al. | 222/190 |
| 2012/0241477 | A1 * | 9/2012 | Uehira et al. | 222/190 |

FOREIGN PATENT DOCUMENTS

| | | | | |
|---|---|---|---|---|
| JP | 08133318 | A | 5/1996 | |
| JP | 10034035 | | 4/1997 | |
| TW | 291409 | U * | 6/2006 | B65D 47/34 |

* cited by examiner

FOAMER PUMP

CROSS-REFERENCES TO RELATED APPLICATIONS

This patent application is a continuation of U.S. patent application Ser. No. 12/912,649 filed Oct. 26, 2010 now U.S. Pat. No. 8,225,965 and entitled Foamer Pump, which is a continuation of U.S. patent application Ser. No. 11/724,412, filed Mar. 15, 2007 now U.S. Pat. No. 7,850,048 and entitled Foamer Pump, which claims the benefit of U.S. Provisional Application Ser. No. 60/854,019, filed Oct. 23, 2006 and entitled Foamer Pump, each of which are incorporated here by this reference.

TECHNICAL FIELD

This invention relates to foam dispensing pumps that foam the fluid being dispensed without the use of aerosol propellants.

BACKGROUND ART

Manually operated dispensers that dispense liquid as a foam are known in the prior art. One of these types of dispensers is a trigger sprayer that pumps liquid from a bottle attached to the trigger sprayer and discharges the liquid as foam. To produce denser foam from a liquid dispenser typically requires that both the liquid and air being mixed by the dispenser be under pressure. This generally means that the foaming dispenser includes both a liquid pump chamber and an air pump chamber. Typically, one or more pistons move between the charge and discharge positions in the air pump chamber and the liquid pump chamber to draw air or liquid into the respective chamber and force the air or the liquid from the chamber.

However, existing foam dispensers often require a number of complex components, multiple pistons, or elaborate passageways within the device. Furthermore, they often require complex check valve mechanisms to ensure proper flow of the liquid and air throughout the device. Additionally, some existing devices rely only on pressure differentials to operate the check valve at the outlet of the liquid pump chamber. So what is needed is a foam producing pump having a simple design utilizing a single piston. What is also needed is a foam pump having positive contact to help unseat the check valve at the outlet of the liquid pump chamber.

DISCLOSURE OF INVENTION

The present invention is directed to a foamer pump for dispensing foam. The foamer pump has a simple construction and utilizes a single piston to engage both a fluid chamber and an air chamber. A portion of the actuating mechanism further helps to unseat a check valve at the outlet of the fluid chamber.

The foamer pump has an axial direction and a radial direction, a first position and a second position. The foamer pump further has a fluid chamber containing a foamable fluid, which has an inlet and an outlet. The outlet of the fluid chamber is connected to a mixing chamber. The foamer pump has an air chamber, which has an air channel. The air channel permits air to enter and exit the air chamber and connects the air chamber to the mixing chamber in the second position of the foamer pump. The air channel connects the air chamber to ambient air in the first position of the foamer pump. The air channel further has an air chamber passageway. The mixing chamber provides a region for combining air from the air chamber with the foamable fluid from the liquid chamber to form an air/liquid mixture.

The foamer pump further has a fluid bottle, a closure, an accumulator, a liquid conduit, an actuator, a piston, an upper check valve, a lower check valve, a spring, a stem, and an aerator.

The fluid bottle contains a foamable fluid. The closure may be shaped and dimensioned to connect to the fluid bottle, and the closure has an upper edge.

The accumulator has an upper edge, and the upper edge, of the accumulator may be connected to the upper edge of the closure. The accumulator has an inner surface, an outer surface, a circumference, and a lower end. The circumference is dimensioned to permit the accumulator to fit within the fluid bottle. The air chamber is within the accumulator.

The liquid conduit may be generally cylindrical and has a circumference that is less than the circumference of the accumulator. The liquid conduit further has an inner surface and an outer surface. The lower end of the accumulator tapers between the circumference of the accumulator and the circumference of the liquid conduit to form a generally continuous surface between the lower end of the accumulator and an upper end of the liquid conduit.

The actuator is slidingly engaged with the closure, and the sliding engagement is such that ambient air may pass between the actuator and the closure. The actuator has an internal passage and an actuator outlet at the end of the internal passage. The mixing chamber is within the internal passage.

The piston is connected to the actuator. The piston has an inner flange and an outer flange, and the inner flange and the outer flange are connected by a generally radial portion of the piston. The outer flange contacts the inner surface of the accumulator to form a generally airtight seal. The inner flange of the piston encloses an axial passage. The inner flange extends to and makes contact with the inner surface of the liquid conduit to form a generally airtight seal. The inner flange of the piston and the liquid conduit enclose the liquid chamber, and the piston has a first sealing member. The air chamber passageway may be in the radial portion of the piston.

The upper check valve is in corresponding relation to an upper valve seat. The upper check valve permits the foamable fluid to flow from the liquid chamber to the mixing chamber, while generally preventing the foamable fluid from flowing from the mixing chamber to the liquid chamber during operation of the foamer pump.

The lower check valve is in corresponding relation to a lower valve seat. The lower check valve permits the foamable fluid to flow from the fluid bottle to the liquid chamber, while generally preventing the foamable fluid from flowing from the liquid chamber to the fluid bottle during operation of the foamer pump.

The spring generally extends between the lower check valve and the upper check valve.

The stem is connected to the actuator, and the stem has a generally axial portion slidingly engaged with the piston and a generally radial portion. The generally radial portion has a second sealing member in corresponding relation to the first sealing member of the piston. The second sealing member of the stein cooperates with the first sealing member of the piston to form a generally airtight seal in the second position of the foamer pump. The second sealing member of the stem moves away from the first sealing member of the piston to permit air to pass between the second sealing member of the stem and the first sealing member of the piston in the first position of the foamer pump. The stem further has a central portion that extends into the axial passage of the piston. The central portion contacts the upper check valve in the second position of the foamer pump, but the central portion generally does not contact the upper check valve in the first position of the foamer pump. The stein has an internal axial passage and a radial passage, where the radial passage connects the internal axial passage to the mixing chamber.

The aerator promotes foaming of the air/liquid mixture, and the aerator is located within the internal passage of the actuator between the mixing chamber and the actuator outlet.

BEST MODE FOR CARRYING OUT THE INVENTION

Figure 1:
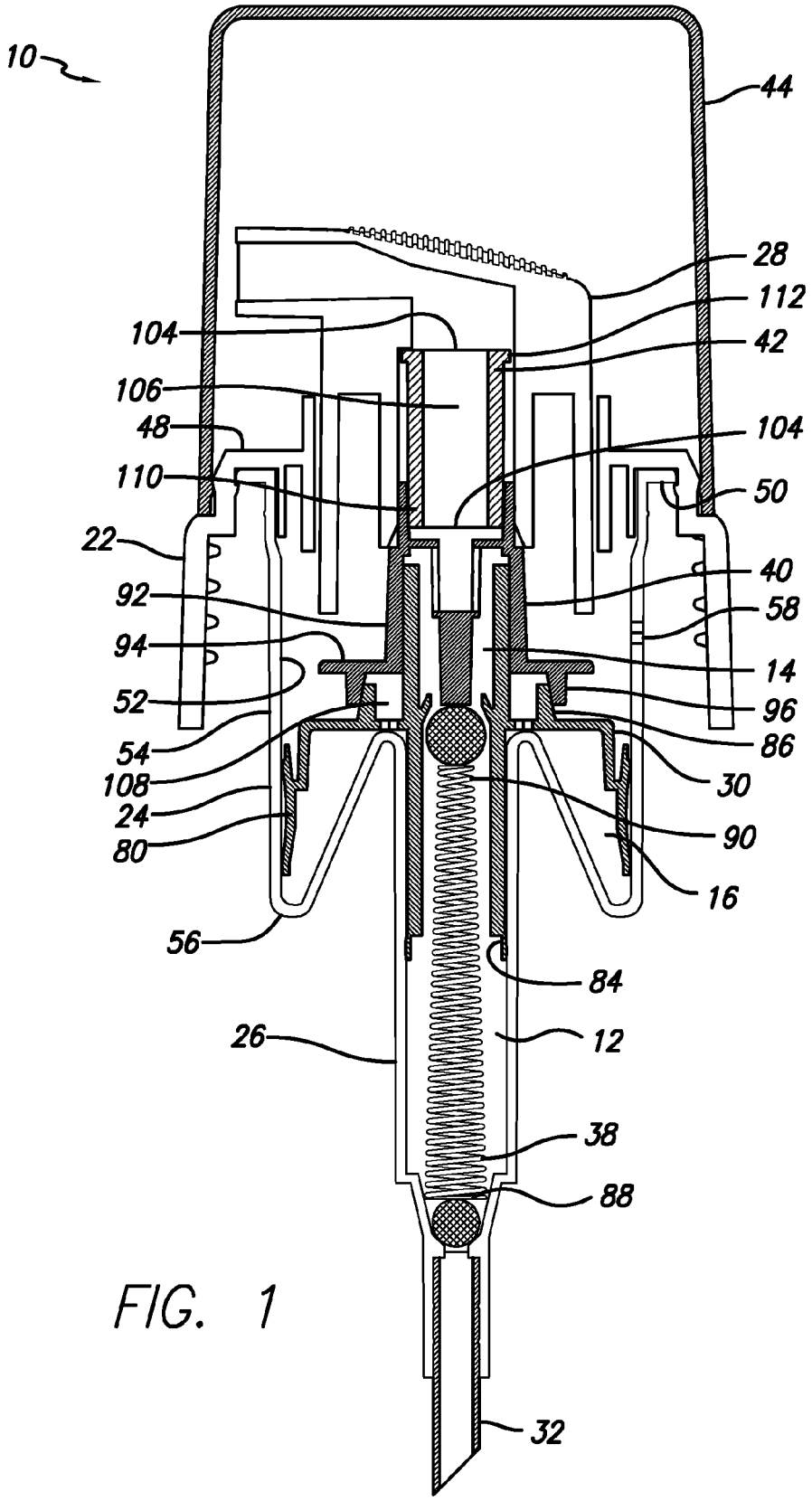
FIG. 1 is a cutaway plan view of an embodiment of a foamer pump in accordance with the invention in a second-position of the foamer pump.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the figures, a foamer pump 10 for dispensing a foam has a fluid chamber 12, a mixing chamber 14, and an air chamber 16. The fluid chamber 12 contains a foamable fluid and has an inlet and an outlet. The outlet of the fluid chamber 12 is connected to the mixing chamber 14. The air chamber 16 has an air channel 108, which permits air to enter and exit the air chamber 16. The air channel 108 connects the air chamber 16 to the mixing chamber 14 in a second position of the foamer pump 10, and the air channel 108 connects the air chamber 16 to ambient air in a first position of the foamer pump 10. The air channel 108 has an air chamber passageway 18. The mixing chamber 14 provides a region for combining air from the air chamber 16 with the foamable fluid from the fluid chamber 12 to form an air/liquid mixture.

The foamer pump 10 further may have a fluid bottle 20, a closure 22, an accumulator 24, a liquid conduit 26, an actuator 28, a piston 30, a dip tube 32, an upper check valve 34, a lower check valve 36, a spring 38, a stem 40, an aerator 42, and an over-cap 44.

As fluid generally flows from the dip tube 32, past the lower check valve 36, through the fluid chamber 12, past the upper check valve 34, and through the actuator 28 to the actuator outlet 72, this direction is here generally termed the downstream direction. The opposite direction is generally termed the upstream direction. As these passages (with the possible exception of the actuator outlet 72) also generally define an axis of symmetry of many of the components, for ease of reference, directions along this axis shall be referred to as the axial direction, while directions perpendicular to the axis shall be referred to as the radial direction.

Figure 2:
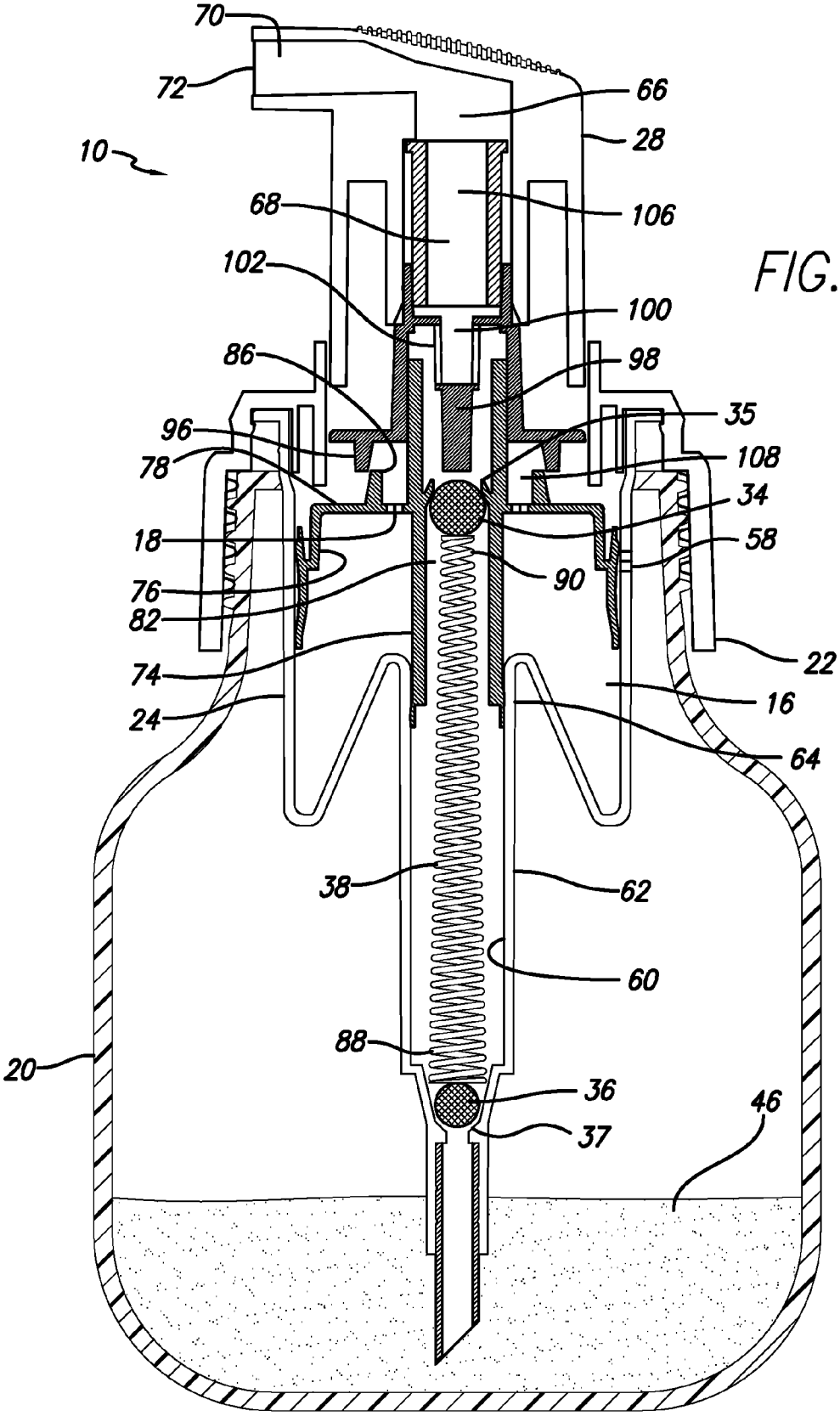
FIG. 2 is a cutaway plan view of an embodiment of a foamer pump in accordance with the invention in a first position of the foamer pump.

The foamer pump 10 is activated by depressing the actuator 28 in the direction of the closure 22. This defines the depression stroke or downward stroke. Following the downward stroke, the foamer pump 10 is in a state referred to as the second condition or second position of the foamer pump 10, an example of which is shown in FIG. 1. Removal of the depressing force (e.g. the user's finger pressure on the actuator 28) causes the actuator 28 to move in the direction away from the closure 22 due to the force exerted by the spring 38 on the actuator 28. This defines the return stroke or upward stroke. Following the upward stroke, the foamer pump 10 is in a state referred to as the first condition or first position of the foamer pump 10, an example of which is shown in FIG. 2.

The fluid bottle 20 contains a foamable fluid 46, and the closure 22 is shaped and dimensioned to connect to the fluid bottle 20. The closure 22 has an upper edge 48. Preferably, the closure 22 has internal threads that mate with external threads on the neck of the fluid bottle 20.

The accumulator 24 has an upper edge 50, and the upper edge 50 of the accumulator 24 is connected to the upper edge 48 of the closure 22. The accumulator 24 is generally cylindrical, and has an inner surface 52, an outer surface 54, an outside diameter or circumference, and a lower end 56. The outside diameter or circumference is dimensioned to permit the accumulator 24 to fit within the fluid bottle 20. The air chamber 16 is within the accumulator 24. The accumulator 24 further may have a side vent hole 58 between the inner surface 52 and the outer surface 54, permitting ambient air to communicate with air inside of the fluid bottle 20 to maintain generally ambient air pressure within the fluid bottle 20. The side vent hole 58 is preferably positioned on the accumulator 24 such that the communication between the ambient air and the air inside of the fluid bottle 20 is permitted in the second position of the foamer pump 10, but the communication is restricted in the first position of the foamer pump 10. This is preferably accomplished by movement of the air chamber scraper 80 over the side vent hole 58 to cover and uncover the side vent hole 58, as further described below.

The liquid conduit 26 is generally cylindrical and has an outside diameter that is less than the outside diameter or circumference of the accumulator 24. The liquid conduit 26 further has an inner surface 60 and an outer surface 62. The lower end 56 of the accumulator 24 tapers between the outside diameter or circumference of the accumulator 24 and the outside diameter of the liquid conduit 26 to form a generally continuous surface between the lower end 56 of the accumulator 24 and an upper end 64 of the liquid conduit 26.

In some embodiments, the liquid conduit 26 may not be cylindrical, and in some embodiments the accumulator 24 may not be cylindrical. In such embodiments, the circumference of the liquid conduit 26 is generally less than the circumference of the accumulator 24.

The actuator 28 is slidingly engaged with the closure 22, and the sliding engagement is such that ambient air may pass between the actuator 28 and the closure 22. The actuator 28 has an internal passage 66, and an actuator outlet 72 is at an end of the internal passage 66. In a version of the invention, a portion 68 of the internal passage 66 is generally in the axial direction and a portion 70 is generally in the radial direction. In such embodiments, the actuator outlet 72 is typically in the radial portion 70.

The piston 30 is connected to the actuator 28. The piston 30 has an inner flange 74 and an outer flange 76, each of which may be generally cylindrical. The inner flange 74 and the outer flange 76 are connected by a generally radial portion 78 of the piston 30. The outer flange 76 further may have an air chamber scraper 80 to contact the inner surface 52 of the accumulator 24 to form a generally airtight seal.

The inner flange 74 of the piston 30 encloses an axial passage 82. The inner flange 74 extends to and makes contact with the inner surface 60 of the liquid conduit 26 to form a generally airtight seal. The inner flange 74 of the piston 30 may further have a liquid chamber scraper 84 to contact the inner surface 60 of the liquid conduit 26 to better form a generally airtight seal. The inner flange 74 of the piston 30 and the liquid conduit 26 enclose the fluid chamber 12.

The generally radial portion 78 of the piston 30 has a first sealing member 86. In an embodiment of the invention, the first sealing member 86 is a generally cylindrical ridge extending toward the actuator 28. The air chamber passageway 18 may be through the radial portion 78 of the piston 30.

The air chamber scraper 80 is positioned such that it generally covers the side vent hole 58 after completion of the return stroke. During the downstroke, the air chamber scraper 80 moves past the side vent hole 58, uncovering the side vent hole 58 and permitting outside ambient air to communicate with air inside of the fluid bottle 20. In this way, ambient pressure is generally maintained in the fluid bottle 20.

The dip tube 32 is connected to the liquid conduit 26 and extends into the foamable fluid within the fluid bottle 20. The dip tube 32 provides a passage for transport of the foamable fluid from the fluid bottle 20 to the liquid conduit 26. Some versions of the invention do not include a dip tube 32. In such versions, the liquid conduit 26 extends into the foamable fluid within the fluid bottle 20.

Figure 3:
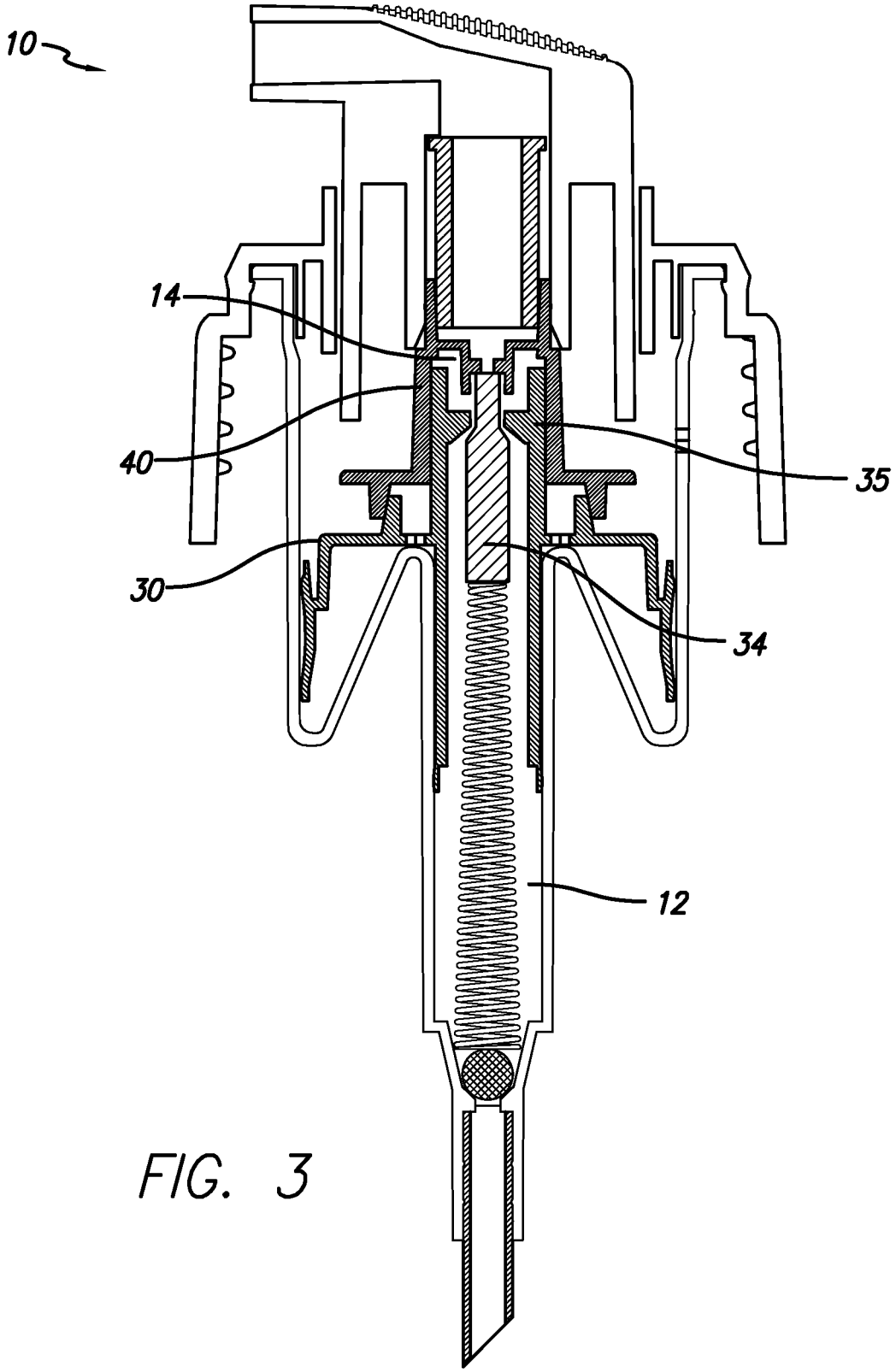
FIG. 3 is a cutaway plan view of an embodiment of a foamer pump in showing an alternative configuration for the upper check valve.

The upper check valve 34 may be generally spherical and is in corresponding relation to an upper valve seat 35. In a version of the invention, an example of which is depicted in FIG. 3, the upper check valve 34 may be generally bottle-shaped, or it may be cylindrical. The upper valve seat 35 may be integral to the piston 30. The upper check valve 34 permits the foamable fluid to flow from the fluid chamber 12 to the mixing chamber 14 in the second condition of the foamer pump 10, while preventing or restricting the foamable fluid from flowing from the mixing chamber 14 to the fluid chamber 12 in the first condition of the foamer pump 10. The upper check valve 34 may be made of glass, metal, plastic, or other durable material.

The lower check valve 36 may be generally spherical and is in corresponding relation to a lower valve seat 37. The lower valve seat 37 is connected to the liquid conduit 26. The lower check valve 36 permits the foamable fluid to flow from the fluid bottle 20 to the fluid chamber 12 in the first condition of the foamer pump 10, while preventing or restricting the foamable fluid from flowing from the fluid chamber 12 to the fluid bottle 20 in the second condition of the foamer pump 10. The lower check valve 36 may be made of glass, metal, plastic, or other durable material.

The spring 38 generally extends between the lower check valve 36 and the upper check valve 34. The spring 38 may be tapered or may otherwise have varying coil dimensions so that it may fit within the liquid conduit 26 and the axial passage 82 within the inner flange 74 of the piston 30. In this way, unlike previous designs that utilize multiple springs and require spring retainers between each spring, only one spring is needed. As such, the design is simplified and fewer components are utilized.

In a version of the invention, the spring 38 is a helical compression spring 38. The spring 38 has a first end 88 and a second end 90, where the first end 88 has a first coil diameter and the second end 90 has a second coil diameter. The second coil diameter is less than the first coil diameter, and the spring 38 tapers from the first end 88 to the second end 90.

The stem 40 is connected to the actuator 28. The stem 40 has a generally axial portion 92 slidingly engaged with the piston 30 and a generally radial portion 94. The generally radial portion 94 has a second scaling member 96 in corresponding relation to the first sealing member 86 of the piston 30. The second sealing member 96 of the stem 40 cooperates with the first sealing member 86 of the piston 30 to form a generally airtight seal in the second position of the foamer pump 10. The second sealing member 96 of the stem 40 moves away from the first sealing member 86 of the piston 30 to permit air to pass between the second sealing member 96 of the stem 40 and the first sealing member 86 of the piston 30 in the first position of the foamer pump 10.

In an embodiment of the invention, the second sealing member 96 may be a generally cylindrical ridge extending toward the radial portion 78 of the piston 30, and the first sealing member 86 may be a generally cylindrical ridge extending toward the actuator 28. The cylindrical ridge of the stem 40 overlaps with the cylindrical ridge of the piston 30 to form a generally airtight seal in the second position of the foamer pump 10. The cylindrical ridge of the stem 40 moves away from the cylindrical ridge of the piston 30 to permit ambient air to pass between the cylindrical ridge of the stem 40 and the cylindrical ridge of the piston 30 in the first position of the foamer pump 10. Ambient air from outside of the foamer pump 10 actuator 28 may then pass through a gap between the actuator 28 and the closure 22, between the radial portion 94 of the stem 40 and the radial portion 78 of the piston 30, and then through the air chamber passageway 18 and into the air chamber 16 to replenish the air chamber 16.

The stern 40 further has a central portion 98 extending into the axial passage 82 of the piston 30. The central portion 98 contacts the upper check valve 34 and unseats it from the upper valve seat 35 in the second position of the foamer pump 10. This motion is resisted by the spring 38, causing the spring 38 to compress. The force created in the compressed spring 38 causes the lower check valve 36 to contact the lower valve seat 37. During the transition from the second position to the first position of the foamer pump 10, the spring 38 pushes the radial portion 94 of the stem 40 away from the radial portion 78 of the piston 30.

The central portion 98 generally does not contact the upper check valve 34 in the first position of the foamer pump 10. As such, the force of the stem 40 against the upper check valve 34 is removed or reduced such that the upper check valve 34 contacts the upper valve seat 35 due to the force in the spring 38. This extension of the spring 38 causes a relative reduction of the force exerted by the spring 38 against the lower check valve 36. As such, the lower check valve 36 is no longer held against the lower valve seat 37 and foamable fluid may travel from the dip tube 32 past the lower check valve 36 and into the fluid chamber 12.

The stem 40 may have an internal axial passage 100 and a radial passage 102, where the radial passage 102 connects the internal axial passage 100 to the mixing chamber 14. The mixing chamber 14 is typically within the generally axial portion 92 of the stem 40. In other versions, therein no radial passage 102.

The aerator 42 promotes foaming of the air/liquid mixture. The aerator 42 is located in the internal passage 66 of the actuator 28, between the mixing chamber 14 and the actuator outlet 72, and preferably within the axial portion 68 of the internal passage 66. The aerator 42 may contain one or more mesh screens 104 through which the air/liquid mixture is forced during the downward stroke to promote foaming of the air/liquid mixture. Preferably, the aerator 42 has a cylinder with a first end 88 and a second end 90, with a mesh screen 104 on the first end 88 and the second end. 90 and a chamber 106 between the first end 88 and the second end 90.

The over-cap 44 is generally cylindrical and has an open end and a dosed end. The over-cap 44 generally fits over the actuator 28, and the open end removably engages the closure 22 to form a protective cap over the actuator 28 when the foamer pump 10 is not in use. The over-cap 44 is removed during use of the foamer pump 10 so that a user may access and depress the actuator 28. Some embodiments of the invention do not include the over-cap 44. Although the over-cap 44 is depicted in FIG. 1, which shows the foamer pump 10 in the second condition, the over-cap 44 would normally be removed so that the actuator 28 could be depressed to activate the foamer pump 10.

During the downstroke, the downward moving piston 30 causes the volume of the air chamber 16 to be reduced. As such, the air within the air chamber 16 is forced out of the air chamber passageway 18 and between the generally axial portion 92 of the stem 40 and the piston 30 so that the air may reach the mixing chamber 14. Alternatively, the air expelled from the air chamber 16 may be forced out of the air chamber passageway 18 and through a port in the piston 30 that connects the air chamber passageway 18 with the mixing chamber 14.

During the downstroke, the downward moving piston 30 also reduces the volume of the fluid chamber 12. As such, liquid from the fluid chamber 12 is forced past the upper check valve 34 (which is unseated by the stem 40) and into the mixing chamber 14 for combination with the air from the air chamber 16.

While the present invention has been described with regards to particular embodiments, it is recognized that additional variations of the present invention may be devised without departing from the inventive concept.

INDUSTRIAL APPLICABILITY

This invention may be applied to the development, manufacture, and use of foam dispensing pumps that foam, the fluid being dispensed without the use of aerosol propellants.

What is claimed is:

1. A dispensing pump constructed and arranged for assembly to a container for dispensing a composition of air and liquid, wherein a supply of said liquid is in said container, said dispensing pump comprising:
   - closure means for assembling said dispensing pump to said container;
   - an actuator received by a portion of said closure means;
   - an accumulator assembled with said closure means, said accumulator defining a liquid flow passage;
   - a piston assembled with said accumulator together defining an air chamber, said piston having a portion and said piston defining an air flow opening through said portion, said air flow opening being constructed and arranged for enabling air flow therethrough into said air chamber and for enabling a flow therethrough of air from within said air chamber for use in said composition;
   - a stem assembled with a portion of said actuator, said stem and said piston cooperatively defining an air passage;
   - first valve means for controlling the passage of liquid through said liquid flow passage;
   - second valve means for controlling the passage of air through said air passage; and
   - wherein said second valve means is constructed and arranged free of any elastomeric component which must deflect for any air valving function.

2. The dispensing pump of claim 1 wherein said first valve means is constructed and arranged free of any of elastomeric component which must deflect for any liquid valving function.

3. The dispensing pump of claim 1 wherein said second valve means includes a first sealing member and a second sealing member.

4. The dispensing pump of claim 3 wherein sealing engagement between said first sealing member and said second sealing member is achieved by an overlapping relationship between said first sealing member and said second sealing member.

5. The dispensing pump of claim 3 wherein said first sealing member is constructed and arranged as a generally cylindrical ridge.

6. The dispensing pump of claim 5 wherein said second sealing member is constructed and arranged as a generally cylindrical ridge.

7. The dispensing pump of claim 1 wherein said first valve means includes a first check valve cooperating with said liquid flow passage.

8. The dispensing pump of claim 7 wherein said first valve means further includes an inlet check valve cooperating with said liquid flow passage.

9. A dispensing pump constructed and arranged for assembly to a container for dispensing a composition of air and liquid, wherein a supply of said liquid is in said container, said dispensing pump comprising:
   - closure means for assembling said dispensing pump to said container;
   - an actuator received by a portion of closure means;
   - an accumulator assembled with said closure means;
   - a unitary piston cooperating with said accumulator to define an air chamber and including a scraper, a first sealing member, a flange member and a portion between said first sealing member and said flange member defining an air flow opening which is constructed and arranged for a flow therethrough of air from within said air chamber for use in said composition and for providing a path for make-up air into said air chamber; and
   - a stem assembled with said actuator and including a second sealing member, said stem being movable with said actuator for cooperating with said first sealing member.

* * * * *